US011311169B2

(12) United States Patent
Feddema et al.

(10) Patent No.: US 11,311,169 B2
(45) Date of Patent: Apr. 26, 2022

(54) DISHWASHER WITH SPRAY SYSTEM ASSEMBLY

(71) Applicant: Whirlpool Corporation, Benton Harbor, MI (US)

(72) Inventors: Mark S. Feddema, Kalamazoo, MI (US); Lisa M. Fehner, Stevensville, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 51 days.

(21) Appl. No.: 16/911,728

(22) Filed: Jun. 25, 2020

(65) Prior Publication Data

US 2020/0323415 A1 Oct. 15, 2020

Related U.S. Application Data

(63) Continuation of application No. 16/039,746, filed on Jul. 19, 2018, now Pat. No. 10,743,740.

(51) Int. Cl.
*A47L 15/23* (2006.01)
*A47L 15/42* (2006.01)

(52) U.S. Cl.
CPC ..... *A47L 15/23* (2013.01); *A47L 15/4221* (2013.01)

(58) Field of Classification Search
None
See application file for complete search history.

(56) References Cited

U.S. PATENT DOCUMENTS

| | | | |
|---|---|---|---|
| 6,959,881 | B2 | 11/2005 | Kim |
| 7,594,513 | B2 | 9/2009 | VanderRoest et al. |
| D675,386 | S | 1/2013 | Burrows et al. |
| 9,032,980 | B2 | 5/2015 | Busing et al. |
| 9,456,730 | B2 | 10/2016 | Bayer et al. |
| 9,763,554 | B2 | 9/2017 | Watson et al. |
| 2012/0111380 | A1 | 5/2012 | Bayer et al. |
| 2017/0071444 | A1 | 3/2017 | Hofmann et al. |

FOREIGN PATENT DOCUMENTS

| | | | |
|---|---|---|---|
| CN | 205625852 | U | 10/2016 |
| CN | 106618426 | A | 5/2017 |
| EP | 2931107 | B1 | 8/2017 |
| JP | 2013255645 | A | 12/2013 |

OTHER PUBLICATIONS https://www.ebay.co.uk/itm/Bosch-SPV40C00GB-05-Slimline-Dishwasher-Bottom-Lower-Spray-Arm-Wash-Bar-/162877020111, Bosch Slimline Dishwasher Bottom Lower Spray Arm Bar, Part No. SPV40C00GB/05, accessed Jul. 18, 2018.

https://www.ebay.ie/itm/Bosch-SRS55C02GB-01-Slimline-Dishwasher-Bottom-Lower-Spray-Arm-Wash-Bar-/162877020189?hash=item25ec3a181d, Bosch Slimline Dishwasher Bottom Spray Arm Wash Bar, Part No. SRS55C02GB/01, accessed Jul. 18, 2018.

(Continued)

*Primary Examiner* — Levon J Shahinian

(74) *Attorney, Agent, or Firm* — McGarry Bair PC

(57) ABSTRACT

A spray system assembly for a household appliance, such as a dishwasher, wherein the spray system assembly can include a diverter housing with a diverter valve, a sprayer mount, and a rotatable sprayer. The rotatable sprayer can include a hub, a spray head, and a pair of spaced spacers. The sprayer mount can include a collar for receiving the hub of the rotatable sprayer. The pair of spaced spacers can circumscribe the hub.

20 Claims, 9 Drawing Sheets

(56) References Cited

OTHER PUBLICATIONS http://www.bosch-home.com/us/store/accessories/00359975, Bosch Spary Arm for Lower Part of Dishwasher, Part No. 00359975, accessed Jul. 18, 2018.

https://www.heritageparts.com/Manufacturers/Viking-Products/VIKING-LOWER-SPRAY-ARM-BEARING/p/VKGRPD130037?gclid=EAIaIQobChMluvjSulCz2QIVUbbACh3Jrg6XEAQYBSABEgL9gvD_BwEhttps://www.heritageparts.com/Manufacturers/Viking-Products/, Viking Lower Spray Arm Bearing, Part No. PD130037, accessed Jul. 18, 2018.

https://www.ebay.com/p/Frigidaire-154568002-Dishwasher-Spray-Arm/2255475767?iid=301501805682, Frigidaire Dishwasher Spray Arm, Part No. 154568002, accessed Jul. 18, 2018.

http://www.appliancespares.co.za/11676/lg%20dishwasher%20spray%20arm%20(lower)%20%20discontinued.aspx, LG Dishwasher Spray Arm (Lower) Discontinued, Part No. $5248FD1067D, accessed Jul. 18, 2018.

DISHWASHER WITH SPRAY SYSTEM ASSEMBLY

CROSS-REFERENCE TO RELATED APPLICATIONS

This application is a continuation of U.S. patent application Ser. No. 16/039,746, filed Jul. 19, 2018, now issued as U.S. Pat. No. 10,743,740, issued Aug. 18, 2020, which is incorporated herein by reference in its entirety.

BACKGROUND

Contemporary automatic dishwashers for use in a typical household include a tub and upper and lower racks or baskets for supporting soiled dishes within the tub. A spray system is provided for re-circulating wash liquid throughout the tub to remove soils from the dishes. The spray system can include a spray system assembly that has at least one removable component. The dishwasher can also include a controller that implements a number of pre-programmed cycles of operation to wash dishes contained in the tub.

BRIEF DESCRIPTION

In one aspect, the disclosure relates to a dishwasher for treating dishes according to at least one automatic cycle of operation, the dishwasher including a tub at least partially defining a treating chamber receiving dishes for treating, a recirculation circuit fluidly coupled to the tub and having an inlet and an outlet, a sprayer mount fluidly coupled to the outlet, and a rotatable sprayer. The rotatable sprayer includes a spray head defining a hollow interior, a hub rotatably coupling the spray head to the sprayer mount wherein the hub includes an inner surface or inside portion that defines a hollow hub interior, and a discontinuous flare coupled to or formed with the inner surface or the inside portion.

Another aspect of the present disclosure relates to an assembly for a dishwasher that includes a diverter valve having a housing incorporating a sprayer mount and a rotatable sprayer. The rotatable sprayer includes a spray head defining a hollow interior, a hub rotatably coupling the spray head to the sprayer mount wherein the hub includes an inner surface or an inside portion that defines a hollow hub interior, and a discontinuous flare coupled to or formed with the inner surface or the inside portion.

DESCRIPTION

Figure 1:
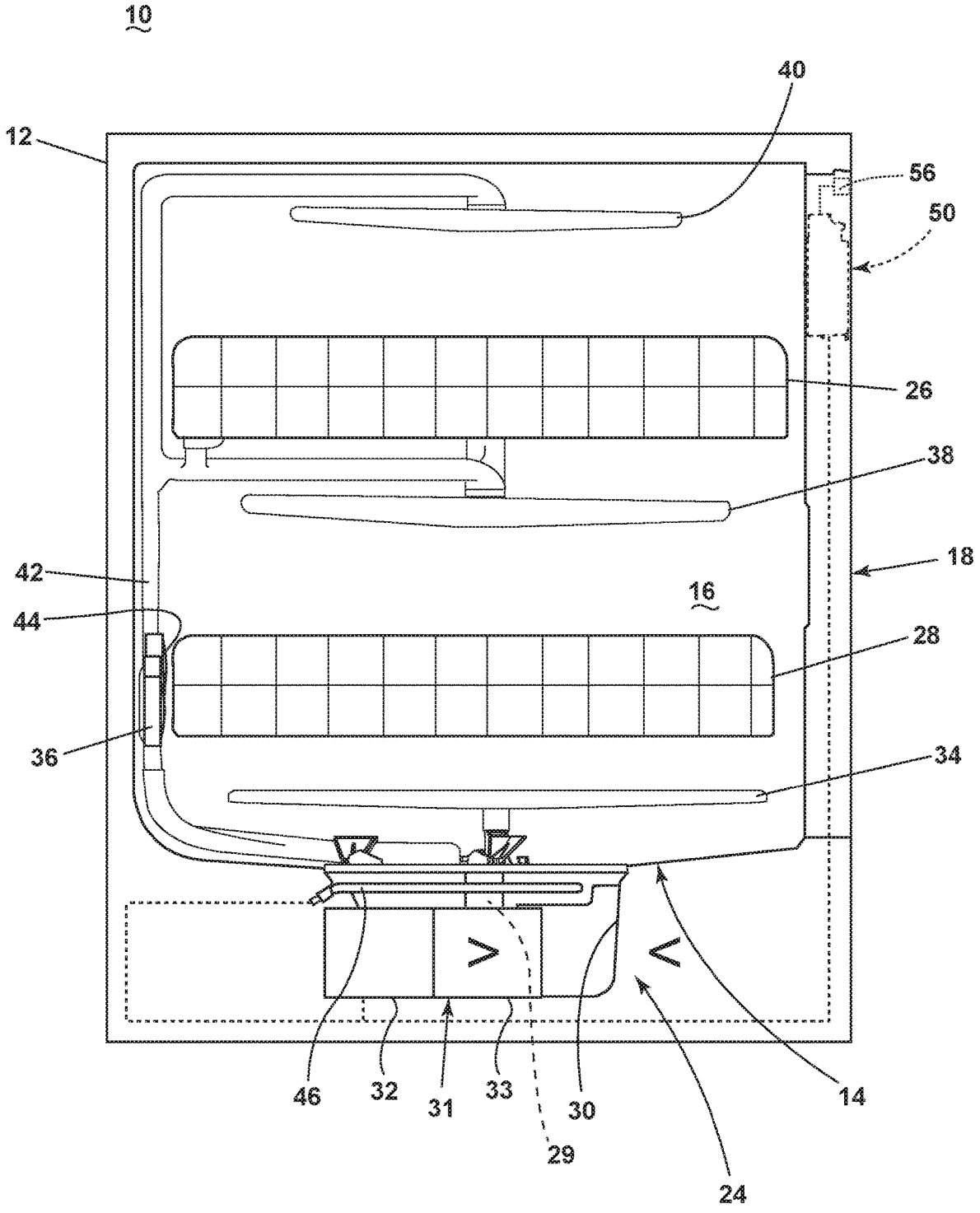
FIG. 1 is a schematic, cross-sectional view of a dishwasher having a spray assembly with a removable sprayer according to an aspect of the disclosure.

The aspects of the present disclosure are generally directed toward a spray system assembly for a dishwasher in which at least one component of the spray system assembly is threadably removable. The spray system assembly can also include one or more specially designed spacers to support, stabilize, or seal components of the spray system assembly.

All directional references (e.g., radial, axial, proximal, distal, upper, lower, upward, downward, left, right, lateral, front, back, top, bottom, above, below, vertical, horizontal, clockwise, counterclockwise, upstream, downstream, forward, aft, etc.) are only used for identification purposes to aid the reader's understanding of the present disclosure, and do not create limitations, particularly as to the position, orientation, or use of aspects of the disclosure described herein. Connection references (e.g., attached, coupled, connected, and joined) are to be construed broadly and can include intermediate members between a collection of elements and relative movement between elements unless otherwise indicated. As such, connection references do not necessarily infer that two elements are directly connected and in fixed relation to one another. The exemplary drawings are for purposes of illustration only and the dimensions, positions, order and relative sizes reflected in the drawings attached hereto can vary.

In FIG. 1, an automated dishwasher 10 according to an aspect of the present disclosure is illustrated. A chassis 12 can define an interior of the dishwasher 10 and can include a frame, with or without panels mounted to the frame. An open-faced tub 14 can be provided within the chassis 12 and can at least partially define a treating chamber 16, having an open face for receiving dishes for treating. A door assembly 18 can be movably mounted to the dishwasher 10 for movement between opened and closed positions to selectively open and close the open face of the tub 14. Thus, the door assembly 18 provides accessibility to the treating chamber 16 for the loading and unloading of dishes or other washable items.

It should be appreciated that the door assembly 18 can be secured to the lower front edge of the chassis 12 or to the lower front edge of the tub 14 via a hinge assembly (not shown) configured to pivot the door assembly 18. When the door assembly 18 is closed, user access to the treating chamber 16 can be prevented, whereas user access to the treating chamber 16 can be permitted when the door assembly 18 is open.

Dish holders, illustrated in the form of upper and lower racks 26, 28, are located within the treating chamber 16 and receive dishes for washing. The upper and lower racks 26, 28 are typically mounted for slidable movement in and out of the treating chamber 16 for ease of loading and unloading. Other dish holders can be provided, such as a silverware basket. As used in this description, the term "dish(es)" is intended to be generic to any item, single or plural, that can be treated in the dishwasher 10, including, without limitation, dishes, plates, pots, bowls, pans, glassware, and silverware.

A spray system is provided for spraying liquid in the treating chamber 16 and can include, but is not limited to, a spray system assembly 34, a lower spray assembly 36, a rotating mid-level spray assembly 38, and/or an upper spray assembly 40. Upper spray assembly 40, mid-level spray assembly 38, and spray system assembly 34 are located, respectively, above the upper rack 26, beneath the upper rack 26, and beneath the lower rack 28 and are illustrated as rotating spray arms. The lower spray assembly 36 is illustrated as being located adjacent the lower rack 28 toward the rear of the treating chamber 16. The lower spray assembly 36 is illustrated as including a vertically oriented distribution header or spray manifold 44. Such a spray manifold is set forth in detail in U.S. Pat. No. 7,594,513, issued Sep. 29, 2009, and titled "Multiple Wash Zone Dishwasher," which is incorporated herein by reference in its entirety.

A recirculation system 24 is provided for recirculating liquid from the treating chamber 16 to the spray system. An input 29 fluidly couples the recirculation system 24 and the tub 14. The recirculation system 24 can include a sump 30 and a pump assembly 31. The sump 30 collects the liquid sprayed in the treating chamber 16 and can be formed by a sloped or recess portion of a bottom wall of the tub 14. The pump assembly 31 can include both a drain pump 32 and one or more recirculation pumps 33. The drain pump 32 can draw liquid from the sump 30 and pump the liquid out of the dishwasher 10 to a household drain line (not shown). The recirculation pump 33 can draw liquid from the sump 30 and the liquid can be simultaneously or selectively pumped through a supply tube 42 to each of the assemblies 34, 36, 38, 40 for selective spraying. While not shown, a liquid supply system can include a water supply conduit coupled with a household water supply for supplying water to the treating chamber 16. The household water supply can include a household cold water supply, household hot water supply, or a mixture as desired.

A heating system including a heating element 46 can be located within the sump 30 for heating the liquid contained in the sump 30.

A controller 50 can also be included in the dishwasher 10, which can be operably coupled with various components of the dishwasher 10 to implement a cycle of operation. The controller 50 can be located within the door assembly 18 as illustrated, or it can alternatively be located somewhere within the chassis 12. The controller 50 can also be operably coupled with a control panel or user interface 56 for receiving user-selected inputs and communicating information to the user. The user interface 56 can include operational controls such as dials, lights, switches, and displays enabling a user to input commands, such as a cycle of operation, to the controller 50 and receive information.

Figure 2:
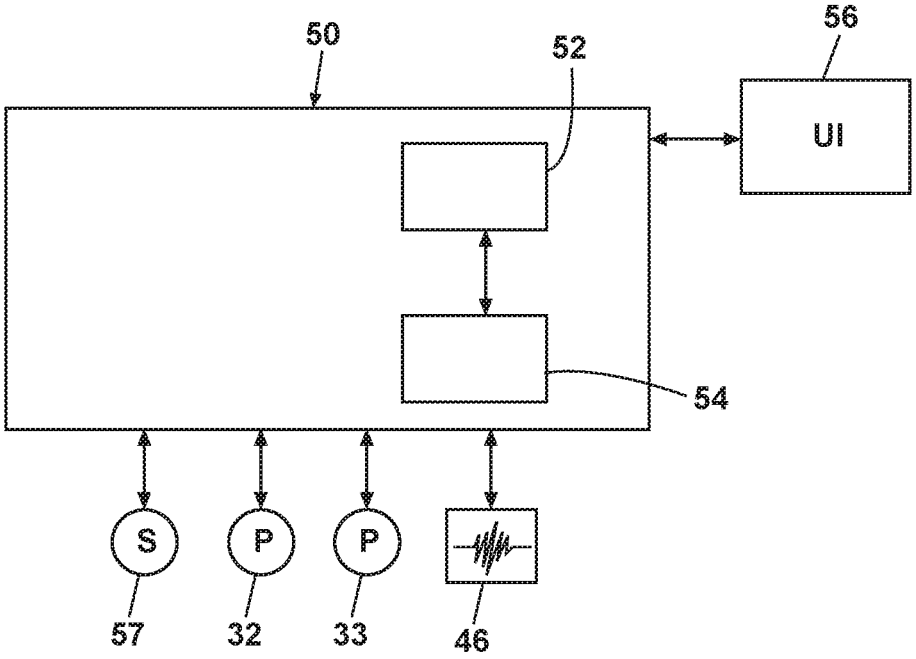
FIG. 2 is a schematic view of a controller of the dishwasher of FIG. 1.

As illustrated schematically in FIG. 2, the controller 50 can be coupled with the heating element 46 for heating the wash liquid during a cycle of operation, the drain pump 32 for draining liquid from the treating chamber 16, and the recirculation pump 33 for recirculating the wash liquid during the cycle of operation. The controller 50 can be provided with a memory 52 and a central processing unit (CPU) 54. The memory 52 can be used for storing control software that can be executed by the CPU 54 in completing a cycle of operation using the dishwasher 10 and any additional software. For example, the memory 52 can store one or more pre-programmed cycles of operation that can be selected by a user and completed by the dishwasher 10. The controller 50 can also receive input from one or more sensors 57. Non-limiting examples of sensors that can be communicably coupled with the controller 50 include a temperature sensor, humidity sensor, and turbidity sensor to determine the soil load associated with a selected grouping of dishes, such as the dishes associated with a particular area of the treating chamber 16.

Figure 3:
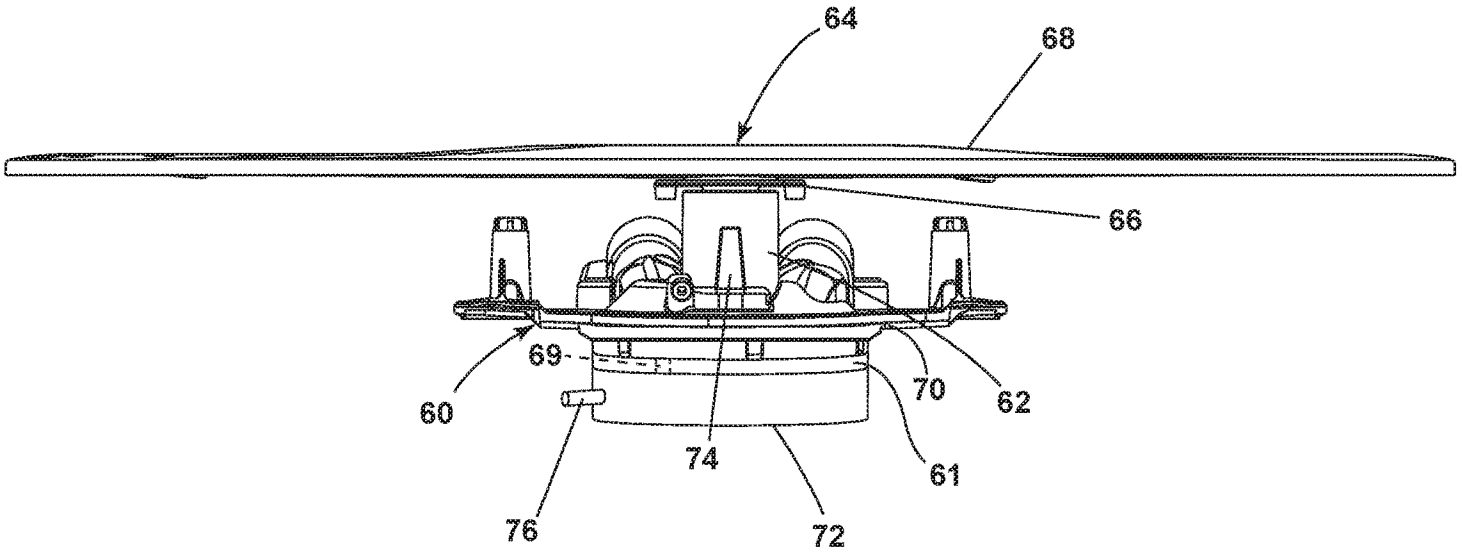
FIG. 3 is a side view of a spray assembly of the dishwasher of FIG. 1.

FIG. 3 is a side view of the spray system assembly 34 of the dishwasher 10 from FIG. 1 having the controller 50 of FIG. 2. The spray system assembly 34 can include, but is not limited to, a diverter housing 60 with a diverter valve 61, a sprayer mount 62, and a rotatable sprayer 64.

The diverter housing 60 includes the diverter valve 61. In a non-limiting example, the diverter valve 61 is illustrated as a disk with a through hole 69. As well known in the art, the diverter valve 61 can rotate so that the through hole 69 changes location. The diverter housing 60 can include an upper housing 70 above the diverter valve 61 and a lower housing 72 below the diverter valve. In a non-limiting example, the sprayer mount 62 can be mounted to the upper housing 70 of the diverter housing 60. The diverter housing 60 fluidly couples an outlet 76 of the recirculation system 24 to the sprayer mount 62. The sprayer mount 62 can include a gap 74.

Figure 4:
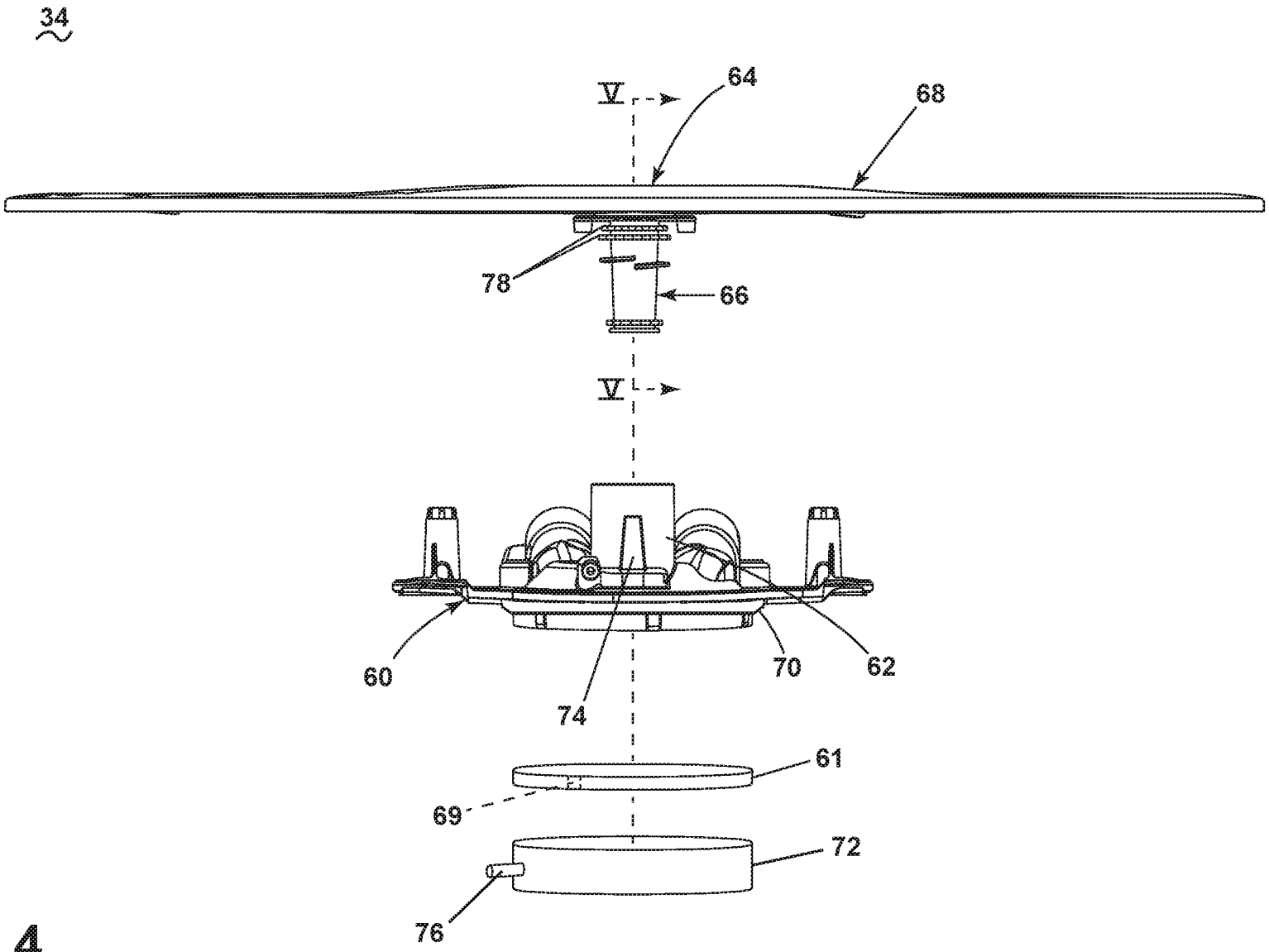
FIG. 4 is an exploded view of the spray assembly of FIG. 3 with a sprayer mount and a hub for a rotatable sprayer.

FIG. 4 is an exploded view of the spray system assembly 34 of FIG. 3 and more clearly shows the rotatable sprayer 64. The rotatable sprayer 64 can include, but is not limited to, a hub 66, a spray head 68, and a pair of spaced spacers, illustrated by way of non-limiting example as upper spacers 78 that circumscribe the hub 66. The spray head 68 can include, but is not limited to, a spray tube, one or more spray arms, or a variety of nozzles as known in the art, or combinations thereof.

The sprayer mount 62 can couple to the hub 66 of the rotatable sprayer 64, which fluidly connects the outlet 76 and the hub 66 via the diverter housing 60. The hub 66 is fluidly coupled to the spray head 68 which is fluidly coupled to the treating chamber 16.

Figure 5:
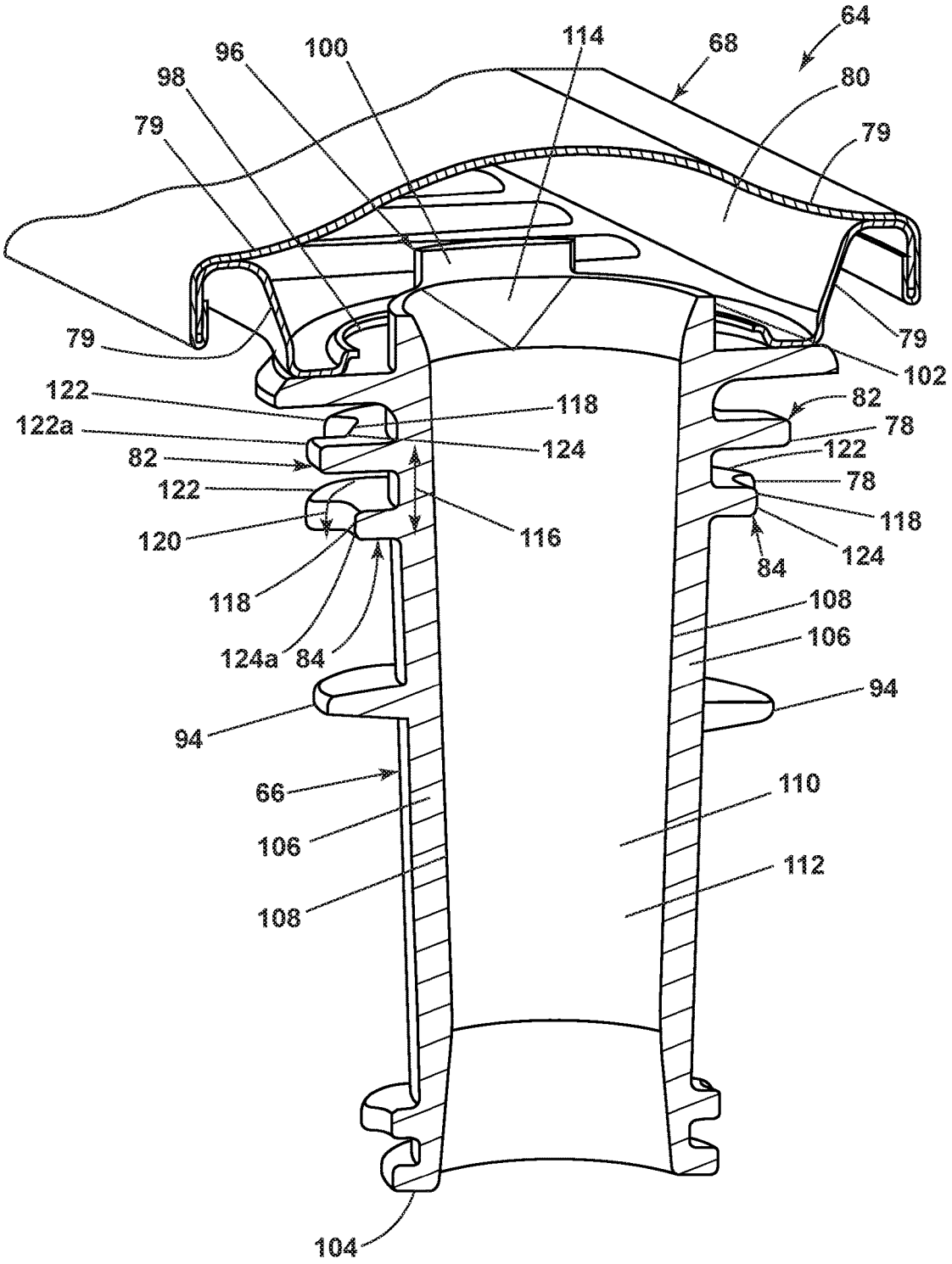
FIG. 5 is a perspective cross-section view of the rotatable sprayer of FIG. 4.

FIG. 5 is a perspective cross-sectional view of the rotatable sprayer 64 from FIG. 4. The spray head 68 of the rotatable sprayer 64 includes spray housing 79 that defines a hollow spray head interior 80.

The hub 66 tapers from a first end 102 proximate the spray head 68 to a second end 104 distal from the spray head 68. The hub 66 has hub walls 106 that have an inner surface or inside portion 108 that defines a hollow hub interior 110. The hollow hub interior 110 can define at least a portion of a liquid passage 112 that fluidly couples to the hollow spray head interior 80 at the first end 102 of the hub 66. The inside portion 108 of the hub walls 106 can include a discontinuous flare 114. As illustrated, by way of non-limiting example, the discontinuous flare 114 can appear as a generally triangular protrusion proximate to the first end 102 of the hub 66.

A second threaded portion 94 included on the hub 66 can rotatably couple the hub 66 to the sprayer mount 62. The second threaded portion 94 is demonstrated in FIG. 4 as a thread that at least partially circumscribes the circumference of the hub 66 and can form a partial turn or one or more turns. It is contemplated that the second threaded portion 94 can be a convex thread or any component or recess used to rotatably mount the hub 66 to the sprayer mount 62.

The upper spacers 78 are located near the first end 102 of the hub 66. The upper spacers 78 can include at least a first spacer 82 and a second spacer 84 that circumscribe the hub 66. The first spacer 82 and the second spacer 84 are spaced a spacer distance 116. The first spacer 82 and the second spacer 84 have radially offset through passages 118 that define at least one circuitous passage 120 through the first spacer 82, the spacer distance 116, and second spacer 84. By way of non-limiting example, the first spacer 82 and the second spacer 84 are illustrated with serrations formed by alternating protrusions 122 and recesses 124 that can define the through passages 118. The serrations of the first spacer 82 and the second spacer 84 are rotationally offset such that the protrusion 122*a* of the first spacer 82 generally aligns with a recess 124*a* of the second spacer 84, further illustrated in FIG. 9.

Lower spacers 88 can be located near the second end 104 of the hub 66. The lower spacers 88 can include a third spacer 90 and a fourth spacer 92 that circumscribe the hub 66. The third spacer 90 is illustrated, by way of non-limiting example, as serrated. The fourth spacer 92 is illustrated by way of non-limiting example, as continuous.

It is contemplated that the hub 66 can include any number of spacers in addition to the upper spacers 78. It is further contemplated that at least one of the spacers 82, 84, 90, or 92 is continuous or at least one of the spacers 82, 84, 90, or 92 is discontinuous.

A removable mount 96 fixes the hub 66 to the spray head 68. By way of non-limiting examples, the removable mount 96 can be a bayonet mount (as illustrated). The spray head 68 can include a receiving portion such as a hollow spray head interior 98 that couples to the protruding portion 100 of the hub 66. However, it is contemplated that the removable mount 96 can be a clasping mechanism or a retaining clip.

Figure 6:
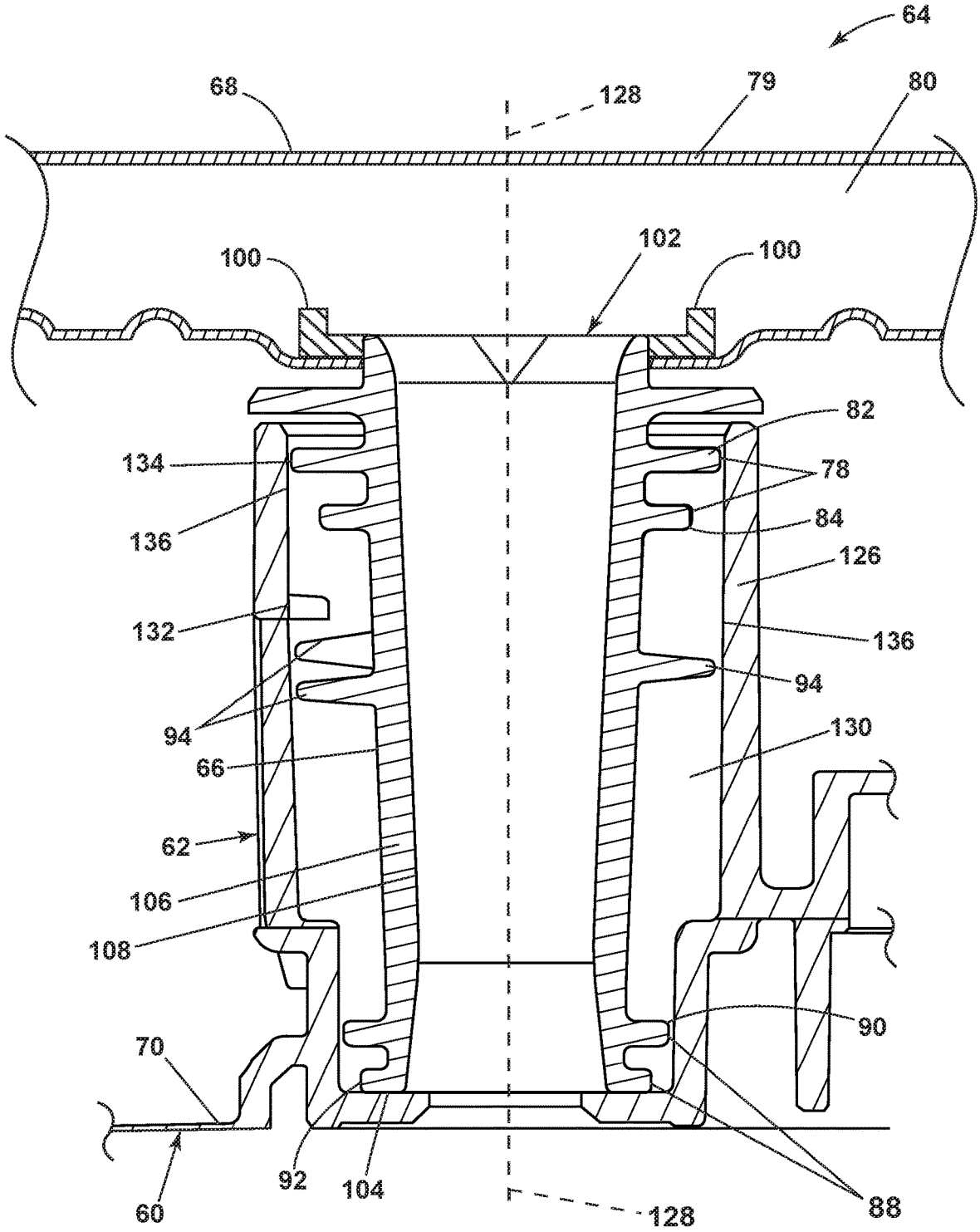
FIG. 6 is a schematic cross-section view of the sprayer mount and the rotatable sprayer of FIG. 3.

FIG. 6 is a cross-sectional view of the rotatable sprayer 64 mounted to the sprayer mount 62. The sprayer mount 62 can include a collar 126 with a centerline 128. The collar 126 can include a collar interior 130 defined by an inner collar surface 136. The collar interior 130 can receive the hub 66 of the rotatable sprayer 64. By way of non-limiting example, mounting of the rotatable sprayer 64 to the sprayer mount 62 can be illustrated by the seconded threaded portion 94 of the hub 66 threaded into and beyond a first threaded portion 132 of the collar interior 130. Mounting the hub 66 into the collar interior 130 can bring the second end 104 of the hub 66 in contact with the sprayer mount 62.

As illustrated, by way of non-limiting example, the first spacer 82 can have an outer portion 134 proximate the collar 126. The outer portion 134 proximate the collar 126 can abut the inner collar surface 136 of the collar 126. However, it is contemplated that any one or more of the spacers 82, 84, 90 or 92 can have an outer portion proximate the collar 126 or abutting the inner collar surface 136 of the collar 126.

When the hub 66 is mounted to the sprayer mount 62, as illustrated in FIG. 3 and FIG. 6, the upper and lower spacers 78, 88 can contribute to the proper positioning of the hub 66 within the sprayer mount 62. The upper and lower spacers 78, 88 can also provide stability to the hub 66 while the hub 66 rotates within the sprayer mount 62. As illustrated, by way of non-limiting example, the fourth spacer 92 at the second end 104 of the hub 66 can help fluidly seal the hub 66 to the sprayer mount 62. Additionally or alternatively, one of more of the first, second, third, or fourth spacers 82, 84, or 90 can help fluidly seal the hub 66.

Figure 7:
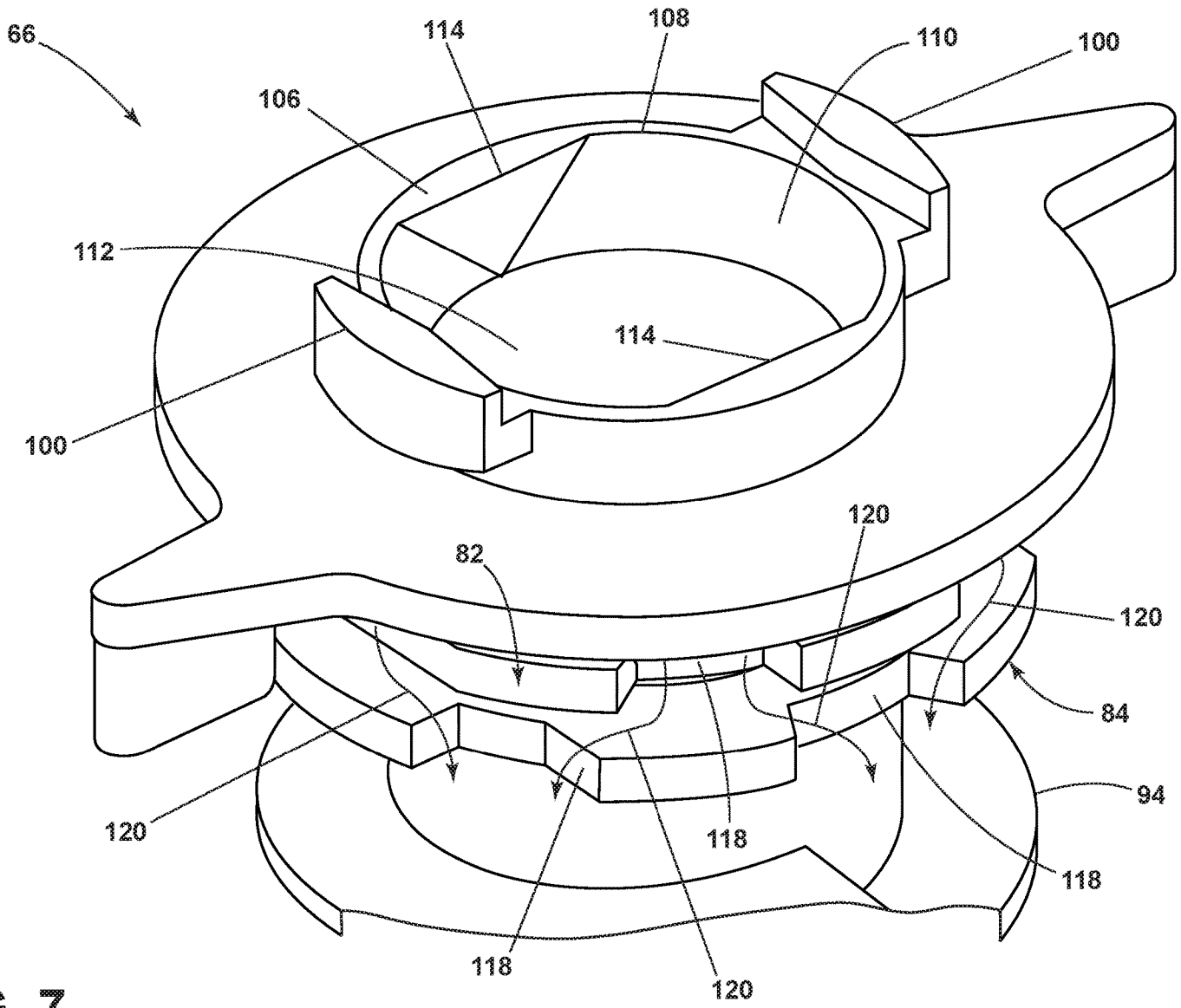
FIG. 7 is a perspective view of a portion of the hub from FIG. 4.

FIG. 7 illustrates a perspective view of a portion of the hub 66, according to the present disclosure further illustrating the offset through passages 118 that can define multiple circuitous passages 120 through the first and second spacers 82, 84.

By way of non-limiting example, FIG. 7 illustrates an exemplary location for the discontinuous flares 114. It is contemplated that any number of discontinuous flares 114 can be used on the inside portion 108 of the hub walls 106 and that the shape of the discontinuous flares 114, by way of non-limiting examples can be a triangular recess. It is contemplated that the discontinuous flares can alternatively or additionally be any irregular protrusion or groove. The discontinuous flares 114 can be used to control or guide fluid flowing from the liquid passage 112 to the hollow spray head interior 98 (FIG. 6).

Figure 8:
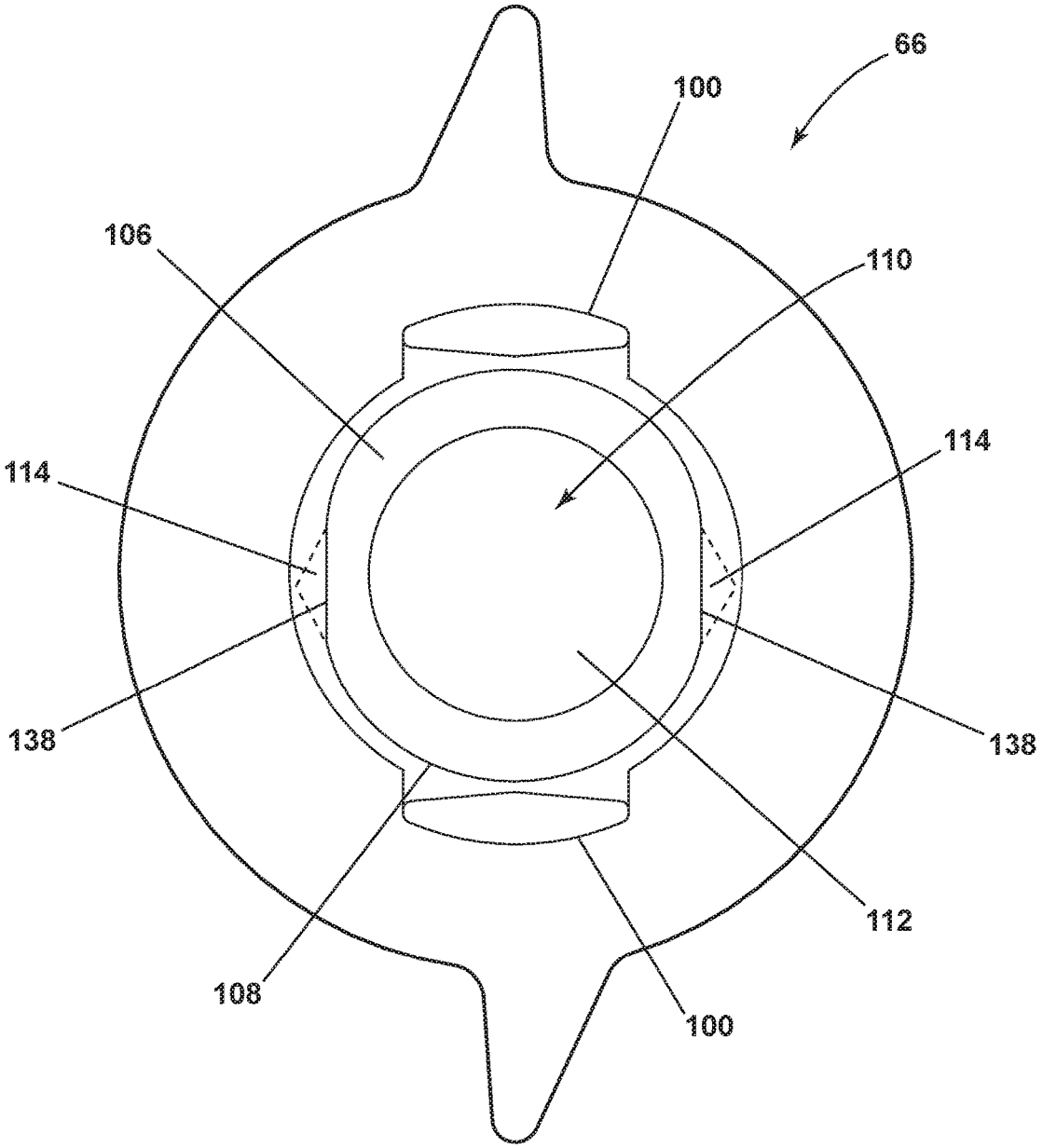
FIG. 8 illustrates a top down schematic view of the hub from FIG. 7.

FIG. 8 illustrates a top down schematic view of the hub 66 from FIG. 7. The discontinuous flares 114 can result in a thickened portion 138 of the hub walls 106 at the first end 102 of the hub 66. The discontinuous flares 114 can taper, by way of non-limiting example, in a triangular shape along the inside portion 108 of the hub 66.

Figure 9:
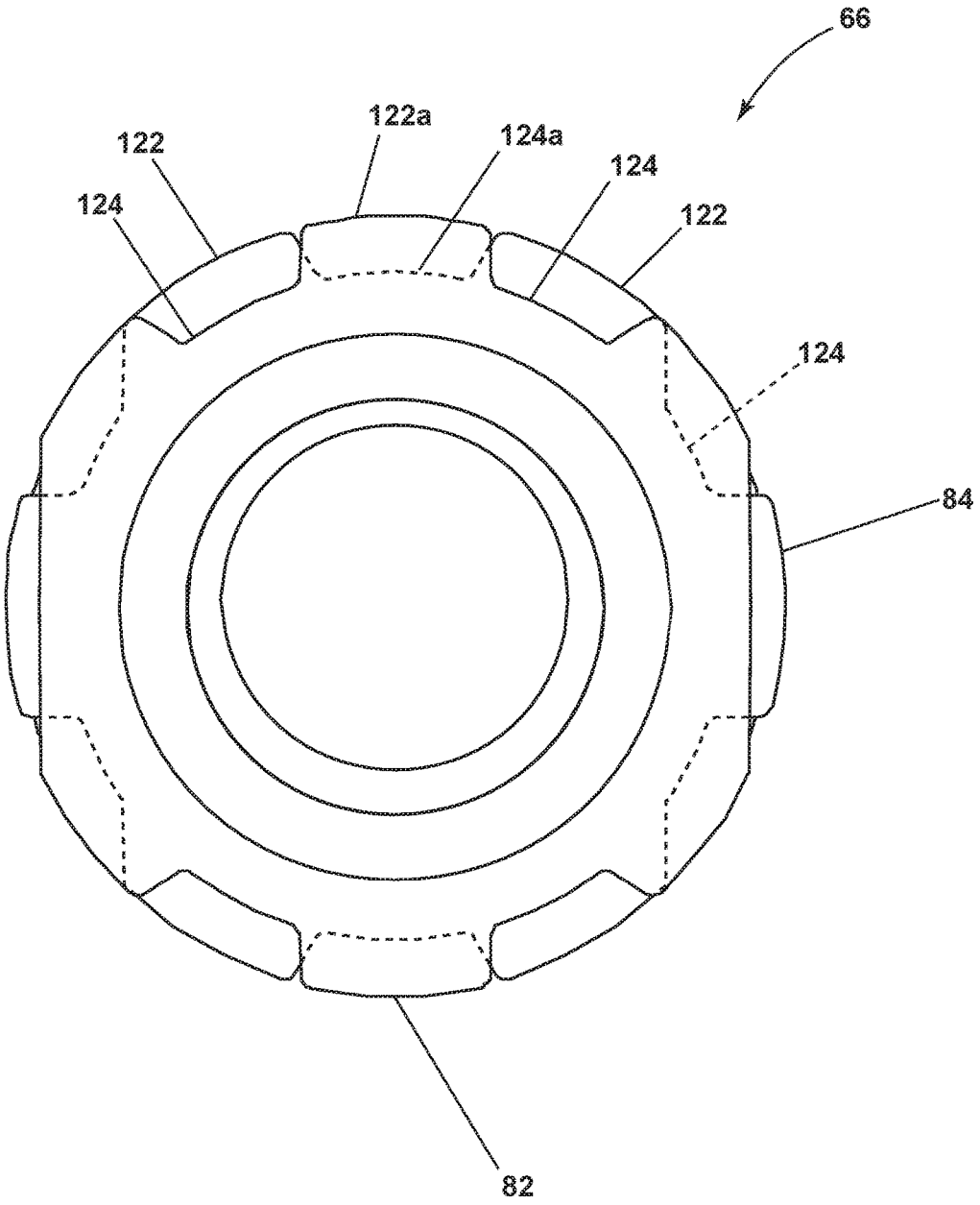
FIG. 9 illustrates a schematic top down view of spacers from FIG. 7.

FIG. 9 illustrates a schematic top down view of the upper spacers 78 of FIG. 7 to further illustrate the rotational offset of the first and second spacer 82, 84. The protrusion 122*a* of the first spacer 82 generally aligns with a recess 124*a* of the second spacer 84. The pattern of overlapping protrusions 122 and recesses 124 continues as the spacers circumscribe the hub 66.

In operation, the hub 66 of the rotatable sprayer 64 can be placed in the collar 126 of the sprayer mount 62. The rotatable sprayer 64 can be rotated about the centerline 128. The rotational direction for threading the rotatable sprayer 64 can be in the same or the opposite of an operational direction of rotation. The rotatable sprayer 64 is coupled in an over-threaded position to the sprayer mount 62 once the second threaded portion 94 extends beyond the first threaded portion 132. The over-threaded position is illustrated in FIG. 6 as the hub 66 is shown mounted to the collar 126.

Once the rotatable sprayer 64 is threaded to the sprayer mount 62, the rotatable sprayer 64 is free to rotate in either a clockwise or counterclockwise direction without fear of uncoupling. FIG. 6 illustrates a non-limiting example in which a retaining force (illustrated as a gravitational force) contributes to keeping the rotatable sprayer 64 mounted to the collar 126 of the sprayer mount 62. The aspects of the present disclosure could be implemented in any orientation and the retaining force can be attained using additional components to provide a force with a similar effect. Additional components can include, but are not limited to one or more magnets to provide a magnetic retaining force or one or more springs to provide elastic retaining force.

When the hub 66 is threadably coupled to the collar 126, as shown in FIG. 6 fluid from the recirculation system 24 can flow through the outlet 76 into the lower housing 72 of the diverter housing 60. The diverter valve 61 fluidly connects the lower housing 72 to the upper housing 70 providing fluid to the collar 126 of the sprayer mount 62 and the hollow hub interior 110 of the hub 66. Fluid flows through the tapered hollow hub interior 110 from the second end 104 to the first end 102. At the first end 102, the fluid is guided from the hollow hub interior 110 to the hollow spray head interior 98 by the discontinuous flare 114. The fluid exits the hollow spray head interior 98 into the treating chamber 16. As the hollow spray head interior 98 of the spray head 68 receives fluid, the rotatable sprayer 64 begins to rotate. The rotation of the rotatable sprayer 64 can help to secure the hub 66 to the sprayer mount 62. The upper and lower spacers 78, 88 can contribute to stabilization or sealing of the hub 66 as it rotates while mounted in the collar 126. The offset through passages 118 of first, second, third spacers 82, 84, and 90 can allow material that enters the collar interior 130 to exit the collar interior 130 through the at least one circuitous passage 120.

Benefits of the present disclosure include stabilization of the hub 66 by the spacers 82, 84, 90, or 92. The serrations of the spacers 82, 84, 90, or 92 can provide the offset passages 118 that help to prevent build-up of foreign material in the collar 126.

To the extent not already described, the different features and structures of the various aspects can be used in combination with each other as desired. That one feature cannot be illustrated in all of the aspects is not meant to be construed that it cannot be, but is done for brevity of description. Thus, the various features of the different aspects can be mixed and matched as desired to form new aspects, whether or not the new aspects are expressly described. Combinations or permutations of features described herein are covered by this disclosure.

This written description uses examples to disclose aspects of the disclosure, including the best mode, and also to enable any person skilled in the art to practice aspects of the disclosure, including making and using any devices or systems and performing any incorporated methods. While aspects of the disclosure have been specifically described in connection with certain specific details thereof, it is to be understood that this is by way of illustration and not of limitation. Reasonable variation and modification are possible within the scope of the forgoing disclosure and drawings without departing from the spirit of the disclosure, which is defined in the appended claims.

What is claimed is:

1. A dishwasher for treating dishes according to at least one automatic cycle of operation, the dishwasher comprising:

a tub at least partially defining a treating chamber receiving dishes for treating;

a recirculation circuit fluidly coupled to the tub and having an inlet and an outlet;

a sprayer mount fluidly coupled to the outlet; and a rotatable sprayer, comprising:

a spray head defining a hollow interior; and a hub rotatably coupling the spray head to the sprayer mount wherein the hub includes a hub wall forming a hollow hub interior and defining at least a portion of a liquid passage that is fluidly coupled to the hollow interior of the spray head via at least one discontinuous flare provided on an inner portion of the hub wall and located at a first end of the hub proximate the spray head.

2. The dishwasher of claim 1 wherein the at least one discontinuous flare comprises multiple discontinuous flares.

3. The dishwasher of claim 2 wherein the multiple discontinuous flares comprises two discontinuous flares spaced on opposite sides of the hollow hub interior formed by the hub wall.

4. The dishwasher of claim 2 wherein the multiple discontinuous flares are spaced about the hub wall.

5. The dishwasher of claim 4 wherein the hub tapers from the first end proximate the spray head to a second end distal from the spray head.

6. The dishwasher of claim 5 wherein the multiple discontinuous flares form thickened portions of the hub wall.

7. The dishwasher of claim 5, further comprising a spacer circumscribing the hub and located near the second end.

8. The dishwasher of claim 5 wherein the at least one discontinuous flare extends from the inner portion of the hub wall into the hollow hub interior.

9. The dishwasher of claim 1 wherein the at least one discontinuous flare is located to control or guide fluid flowing from the liquid passage to hollow interior of the spray head.

10. The dishwasher of claim 1 wherein the hub tapers from the first end proximate the spray head to a second end distal from the spray head.

11. The dishwasher of claim 10 wherein the at least one discontinuous flare forms a thickened portion of the hub wall at the first end.

12. The dishwasher of claim 10 wherein the at least one discontinuous flare is a protrusion.

13. The dishwasher of claim 12 wherein the protrusion is a generally triangular protrusion.

14. The dishwasher of claim 13 wherein a base of the triangular protrusion is adjacent the first end and an apex of the triangular protrusion is directed towards the second end of the hub.

15. The dishwasher of claim 14 wherein the at least one discontinuous flare extends from the inner portion of the hub wall into the hollow hub interior.

16. The dishwasher of claim 15 wherein the extension into the hollow interior of the triangular protrusion decreases from the base to the apex such that the hub wall is thinner at the apex than at the base.

17. The dishwasher of claim 1 wherein the hub further comprises at least one protruding portion that can be received by the spray head.

18. The dishwasher of claim 17 wherein at least a portion of the at least one discontinuous flare is located on the at least one protruding portion.

19. The dishwasher of claim 17 wherein the at least one discontinuous flare is adjacent and separate from the at least one protruding portion.

20. The dishwasher of claim 1 wherein the at least one discontinuous flare extends from the inner portion of the hub wall into the hollow hub interior.

* * * * *